US011197495B1

(12) United States Patent
Bohl, Sr.

(10) Patent No.: US 11,197,495 B1
(45) Date of Patent: Dec. 14, 2021

(54) ROLLING APPARATUS TO FORM DIFFERENT SIZED CIGARETTES WITH ENHANCED EFFICIENCY

(71) Applicant: Trent Alan Bohl, Sr., Athens, GA (US)

(72) Inventor: Trent Alan Bohl, Sr., Athens, GA (US)

( * ) Notice: Subject to any disclaimer, the term of this patent is extended or adjusted under 35 U.S.C. 154(b) by 332 days.

(21) Appl. No.: 16/517,345

(22) Filed: Jul. 19, 2019

Related U.S. Application Data

(60) Provisional application No. 62/700,698, filed on Jul. 19, 2018.

(51) Int. Cl.
*A24C 5/44* (2006.01)
*A24C 5/46* (2006.01)

(52) U.S. Cl.
CPC . *A24C 5/44* (2013.01); *A24C 5/46* (2013.01)

(58) Field of Classification Search
CPC ..... A24C 5/44; A24C 5/46
USPC ..... 131/47
See application file for complete search history.

(56) References Cited

U.S. PATENT DOCUMENTS

| | | | | |
|---|---|---|---|---|
| 44,926 | A * | 11/1864 | Arnold | A24C 5/44 131/47 |
| 55,217 | A * | 5/1866 | Reiniger | A24C 1/10 131/52 |
| 408,067 | A * | 7/1889 | Becker | A24C 5/44 131/49 |
| 2,405,388 | A | 8/1946 | Zint | |
| 9,943,102 | B1 | 4/2018 | Bohl, Sr. | |

* cited by examiner

*Primary Examiner* — Eric Yaary
*Assistant Examiner* — Russell E Sparks
(74) *Attorney, Agent, or Firm* — Plager Schack LLP; Mark H. Plager; Kara Verryt

(57) ABSTRACT

A cigarette rolling apparatus designed to form a cigarette by rolling a paper around a smoking material is provided. The apparatus includes a base, a ramp coupled to the base, a handle with arms pivotably mounted to the base and having rollers rotatably mounted to the arms, and a belt with first and second ends coupled to the base so that the belt extends along the ramp and around the rollers mounted to the handle. The handle in a load position forms a U-shaped pocket in the belt between the ramp and rollers to receive the smoking material and a portion of the belt on the ramp to receive the paper. Pivotal movement of the handle from the load position toward the front end of the base allows the rollers to apply compression forces on portions of the belt to roll the paper around the smoking material.

10 Claims, 4 Drawing Sheets

ROLLING APPARATUS TO FORM DIFFERENT SIZED CIGARETTES WITH ENHANCED EFFICIENCY

RELATED APPLICATION

The application claims priority to provisional patent application U.S. Ser. No. 62/700,698 filed on Jul. 19, 2018, the entire contents of which is herein incorporated by reference.

BACKGROUND

The embodiments herein relate generally to cigarettes for use with herbal products or tobacco. More specifically, embodiments of the invention are directed to a rolling machine that forms different sized cigarettes with enhanced efficiency.

The majority of individuals cannot roll an herbal or tobacco cigarette. In order to form a cigarette, rolling paper is rolled into a tubular member that serves as a housing for smoking material. Several cigarette rolling apparatuses exist as disclosed in U.S. Pat. Nos. 2,405,388 and 9,943,102. However, these devices are limited because they: (1) require hand dexterity to manually operate the apparatus; (2) do not easily roll cigarettes with different sized diameters; (3) have limited efficiency in forming cigarettes; and/or (4) do not capture extraneous herbal product or tobacco that falls out while rolling the paper to form the cigarette.

As such, there is a need in the industry for a cigarette rolling machine with enhanced efficiency that addresses the limitations of the prior art.

SUMMARY

In certain embodiments of the invention, a cigarette rolling apparatus for use to form different sized cigarettes with enhanced efficiency is provided. The cigarette rolling apparatus is configured to form a cigarette by rolling a paper around a smoking material. The cigarette rolling apparatus comprises a base comprising a main plate and a pair of side plates coupled thereto, the pair of side plates extending along opposing side edges of the main plate, a ramp coupled to a top face of the main plate, the ramp comprising a top surface that extends along a curved pathway from a front end of the ramp to a rear end of the ramp, a handle comprising a pair of arms pivotably mounted to the pair of side plates of the base, the handle comprising a pair of rollers rotatably mounted to the pair of arms of the handle, and a belt comprising a first end coupled to the main plate proximate a front end of the base and a second end coupled to the main plate proximate a rear end of the base, the belt extending along the top surface of the ramp and around the pair of rollers mounted to the handle, wherein the handle in an upright load position forms a U-shaped pocket in the belt between the ramp and pair of rollers configured to receive the smoking material therein and a portion of the belt on the top surface of the ramp configured to receive the paper, wherein pivotal movement of the handle from the upright load position toward the front end of the base allows the pair of rollers to rotatably adjust and apply compression forces on portions of the belt to roll the paper around the smoking material on the belt, thereby forming the cigarette.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
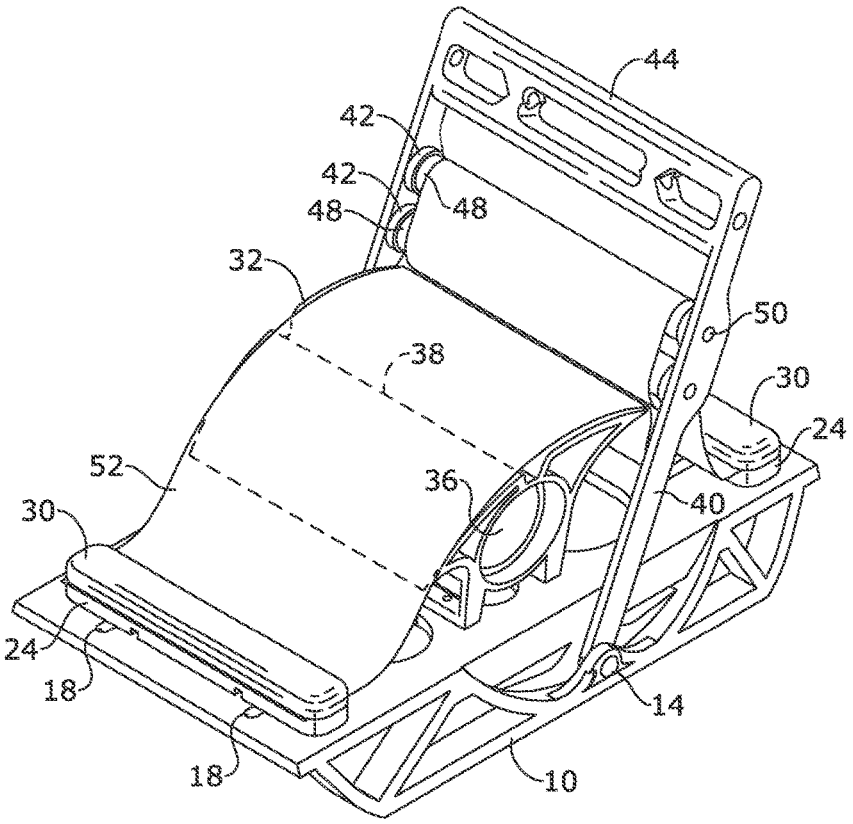
FIG. 1 depicts a perspective view of certain embodiments of the cigarette rolling apparatus.

In certain embodiments as depicted in FIGS. 1-4, the cigarette rolling apparatus is configured to roll a cigarette or cigar. For simplicity, the operation of the apparatus will be described for use to roll a cigarette in embodiments of the invention. However, it shall be appreciated that the same operation of the apparatus can be used to roll a cigar as desired.

The cigarette rolling apparatus is advantageous because it can roll a paper around a smoking material with enhanced efficiency while capturing excess smoking material waste that squeezes out during the rolling procedure. The smoking material used to form the cigarette can be any type of tobacco or herbal ingredients.

In certain embodiments as depicted in FIGS. 1-4, the cigarette rolling apparatus generally comprises base 10, ramp 32, handle 44, belt 52, a pair of clamps each comprising lower clamp arm 24 and upper clamp arm 30, and a pair of roller assemblies comprising roller cores 46 and outer rollers 48. Components of the cigarette rolling apparatus including at least base 10, ramp 32, handle 44, lower and upper clamp arms 24, 30, roller cores 46 and outer rollers 48 can be made from any materials including, but not limited to, any type of metal, wood, plastic or other materials.

In one embodiment as depicted in FIGS. 1-4, base 10 of the cigarette rolling apparatus comprises main plate 11 connected to a pair of side plates 13. The pair of side plates 13 is coupled to and extends along opposing side edges of main plate 11. Main plate 11 and the pair of side plates 13 can be continuously connected together, or coupled together by an adhesive, mechanical fasteners or other fastening components. In one embodiment, each side plate 13 comprises any number of slots 12. At least one slot 12 in each side plate 13 creates room to mount handle 44 thereto as will be described in embodiments of the invention.

Figure 4:
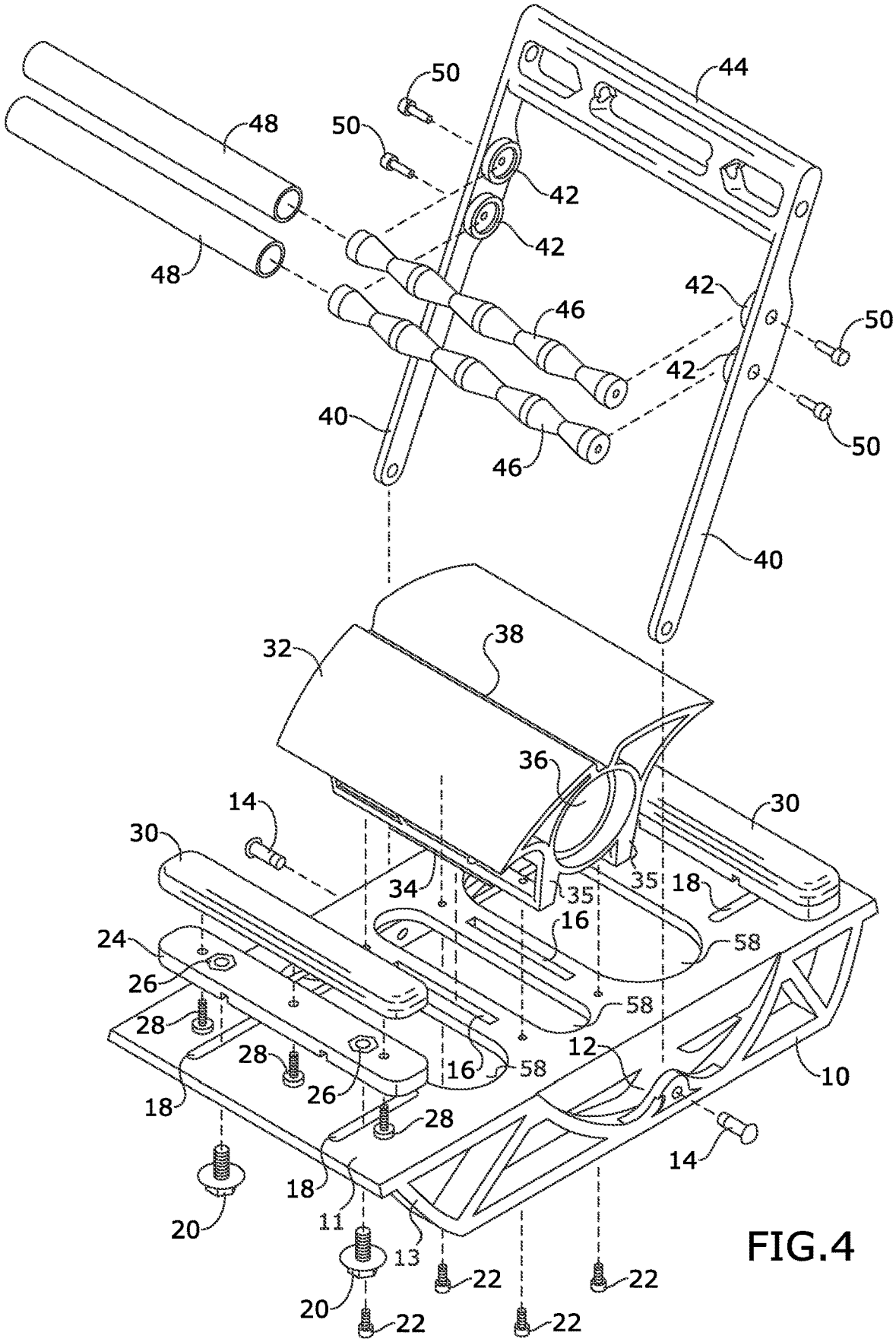
FIG. 4 depicts an exploded view of certain embodiments of the cigarette rolling apparatus.
Figure 5:
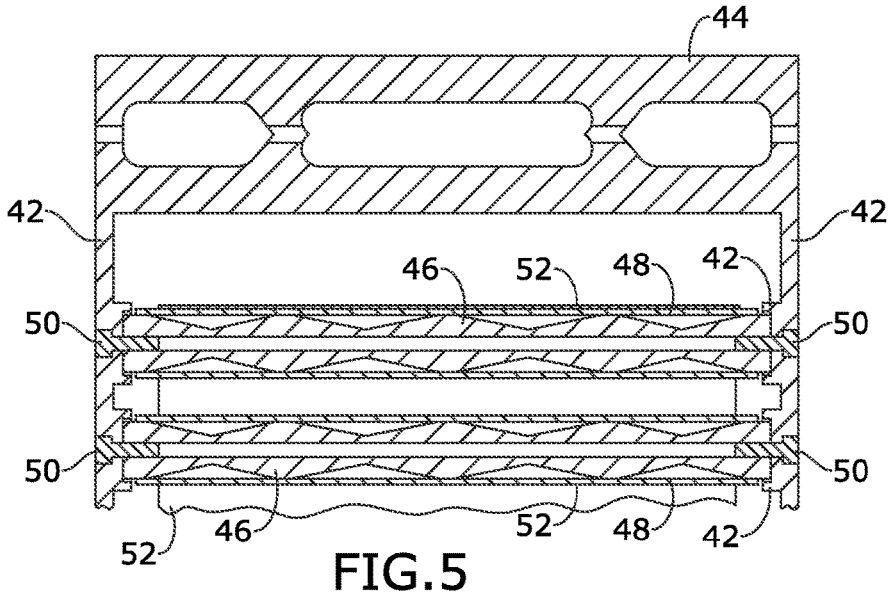
FIG. 5 depicts a section view of certain embodiments of the cigarette rolling apparatus taken along line 5-5 in FIG. 2.
Figure 7:
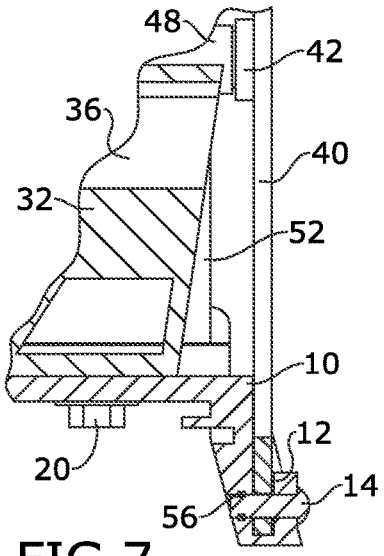
FIG. 7 depicts a section view of certain embodiments of the cigarette rolling apparatus taken along line 7-7 in FIG. 2.

In one embodiment as depicted in FIGS. 1-2, 4 and 7, handle 44 comprises a pair of arms 40 that is pivotably mounted to the pair of side plates 13 of base 10. As depicted in FIGS. 4 and 7, each arm 40 of handle 44 is pivotably mounted to side plate 13 by pivot pin 14 and retainer ring 56. In a preferred embodiment, each arm 40 is mounted to one side plate 13 by pivot pin 14 and retainer ring 56 at a location that is off-center on base 10.

In one embodiment as depicted in FIGS. 1-2 and 4-5, a pair of roller assemblies is rotatably mounted to arms 40 of handle 44. The interior surfaces of arms 40 comprise slots 42 as depicted in FIG. 4. Each roller assembly comprises roller core 46 and outer roller 48 both mounted to a corresponding pair of slots 42 aligned together and located on opposing arms 40. In one embodiment, each roller assembly is coupled to handle 44 by securing opposing ends of roller core 46 inside slots 42 on arms 40. A pair of screws 50 secure roller core 46 to arms 40. Outer roller 48 is disposed around roller core 46. In this embodiment, roller core 46 of each roller assembly is fixed to arms 40, but outer roller 48 is configured to rotate relative to roller core 46. In an alternative embodiment, it shall be appreciated that the pair of roller assemblies may comprise alternative components that may include rollers, bearings and other components.

In certain embodiments, main plate 11 of base 10 serves as the mounting plate for ramp 32 and the pair of clamps. In one embodiment as depicted in FIG. 4, main plate 11 comprises a pair of ramp slots 16, clamp anchor slots 18 and a plurality of openings 58. Ramp 32 is mounted to the top face of main plate 11.

Figure 2:
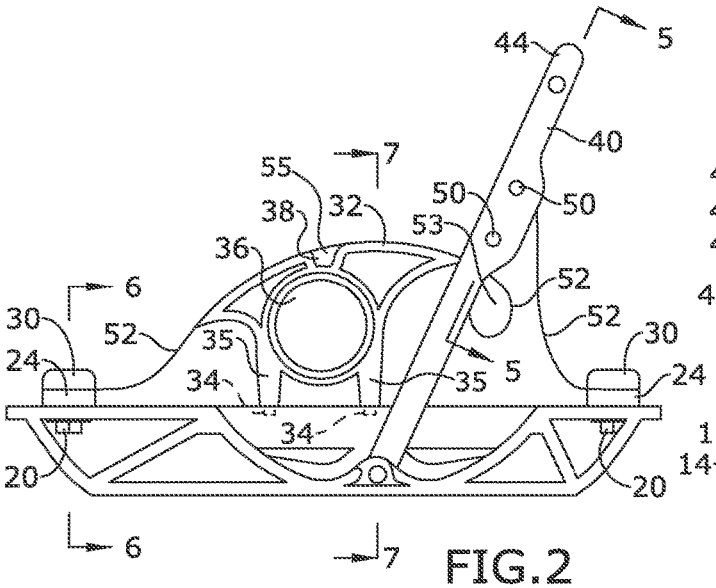
FIG. 2 depicts a side view of certain embodiments of the cigarette rolling apparatus.

In one embodiment as depicted in FIGS. 1-2 and 4, ramp 32 comprises a top surface and a pair of legs 35. As depicted in FIG. 2, the bottom portions of legs 35 comprise feet 34, which snap into ramp slots 16 in main plate 11 of base 10. In one embodiment, the pair of legs 35 are also mechanically fastened to main plate 11 by a plurality of screws 22. It shall be appreciated that any number of screws 22 can be used to couple legs 35 to main plate 11. In alternative embodiments, other fastening components can be used to secure ramp 32 to main plate 11 of base 10.

In one embodiment, the top surface of ramp 32 extends along a curved pathway from the front end to the rear end of ramp 32. In one embodiment, the profile of ramp 32 follows a pathway in accordance with a Fibonacci profile. As depicted in FIGS. 1-2 and 4, the front end of ramp 32 is located a first distance from main plate 11 and the rear end of ramp 32 is located a second distance from main plate 11. In a preferred embodiment, the first distance is less than the second distance. The curvature of the top surface of ramp 32 and distinctive shape facilitate the efficient rolling of cigarettes as will be described in embodiments of the invention.

In one embodiment, ramp 32 comprises storage compartment 36, which is accessible either on one or both sides of ramp 32. Storage compartment 36 is configured to store any plurality of items which include, but is not limited to, smoking material, rolling papers, tools, other items or accessories. In one embodiment as depicted in FIGS. 1-2 and 4, notch 38 extends along a central portion of the top surface of ramp 32.

Figure 3:
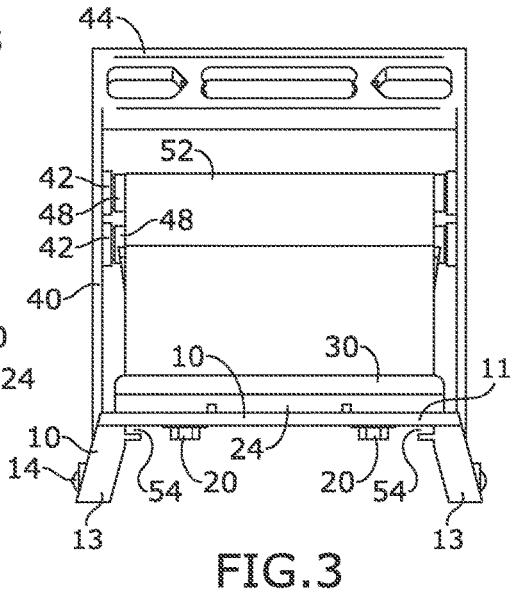
FIG. 3 depicts a front view of certain embodiments of the cigarette rolling apparatus.

In certain embodiments as depicted in FIGS. 1-3, belt 52 comprises a first end coupled to main plate 11 proximate a front end of base 10 and a second end coupled to main plate 11 proximate a rear end of base 10. Belt 52 can be made from various materials. In a preferred embodiment, belt 52 is made from a flexible screen mesh made from fiber, such as KEVLAR brand fiber, that is poly coated. In one embodiment, belt 52 comprises approximate dimensions of a 10"-24" length and 4⅓"-14" width. However, the dimensions of belt 52 can vary.

In a preferred embodiment, the first and second ends of belt 52 are slidably mounted to main plate 11 of base 10. In one embodiment, clamps secure the first and second ends of belt 52 to main plate 11. As depicted in FIGS. 1-4 and 6, a first clamp comprising lower and upper clamp arms 24, 30 is slidably mounted to main plate 11 of base 10. More specifically, lower clamp arm 24 comprises a pair of nuts 26 that are aligned with a pair of clamp anchor slots 18 on main plate 11. A pair of anchor screws 20 extends through clamp anchor slots 18 in main plate 11 and engages with the pair of nuts 26 in lower clamp arm 24. Upper clamp arm 30 is coupled to lower clamp arm 24 by a plurality of clamp screws 28. In this configuration, the clamp is configured to secure the first end of belt 52 between lower and upper clamp arms 24, 30 at a location proximate the front end of base 10. Similarly, a second clamp comprising lower and upper clamp arms 24, 30 is slidably mounted to main plate 11 of base 10 in the same manner described to secure the second end of belt 52 to a location proximate the rear end of base 10.

Once secured to the clamps, belt 52 extends from the first clamp along the top surface of ramp 32, around the pair of outer rollers 48 on handle 44, and engages with the second clamp as depicted in FIGS. 1-3 and 8. The first and second clamps are configured to slidably adjust relative to base 10 as permitted by the movement of anchor screws 20 within corresponding clamp anchor slots 18 on main plate 11 to adjust the degree of slack in belt 52. It shall be appreciated that alternative components including track components, sliding components, wheels or other components can be used in alternative embodiments to slidably mount the first and second clamps to main plate 11.

Figure 8:
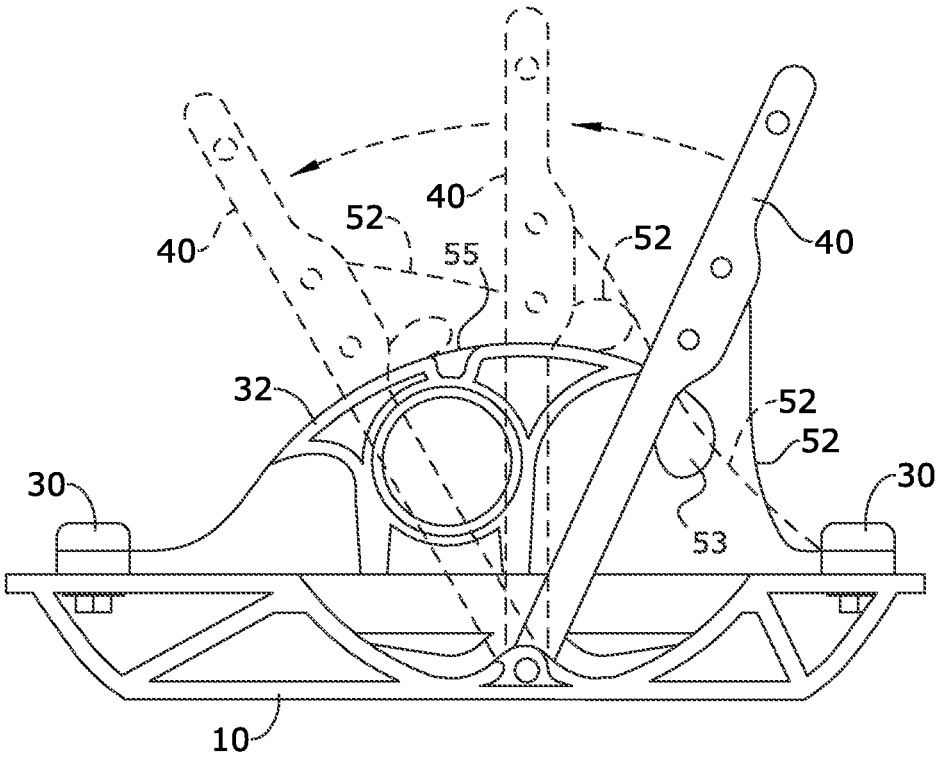
FIG. 8 depicts a side view of certain embodiments of the cigarette rolling apparatus.

In operation, handle 44 of the cigarette rolling apparatus is pivotably adjusted to the upright loading position as depicted in FIGS. 1-2 and 8. In FIG. 8, arm 40 of handle 44 depicted with solid lines illustrates the upright loading position. In this position, belt 52 forms U-shaped pocket 53 located between ramp 32 and outer rollers 48. The smoking material used to roll the cigarette is disposed in U-shaped pocket 53. As depicted in FIGS. 2 and 8, a paper is disposed on belt portion 55 of belt 52 located on the top surface of ramp 32. A liquid such as distilled water, other fluid or adhesive is applied to a top portion of the paper to keep the cigarette in its final form after it is rolled.

In one exemplary embodiment, handle 44 is pivotably adjusted toward the front end of base 10 in the direction of the arrows in FIG. 8. The pivotal movement of handle 44 allows belt 52 to move along the rotating outer rollers 48. This compresses the smoking material in U-shaped pocket 53 of belt 52 so that it can be dispensed on the paper on belt portion 55. As handle 44 continues to pivotably adjust toward the front end of base 10 through the various positions of arm 40 denoted by dotted lines in FIG. 8, outer rollers 48 continue to rotate and apply compression forces on portions of belt 52 to roll the paper around the smoking material. Once rolled, the finished cigarette is ejected off belt 52. Notch 38 on ramp 32 serves as a stop location that can release the finished cigarette from belt 52. Handle 44 is pivotably adjusted back to the upright loading position and the process described is repeated to roll additional cigarettes as desired.

It shall be appreciated that the shape of ramp 32 and off-center mounting location of handle 44 on base 10 help to facilitate the efficient process of rolling cigarettes. It shall be appreciated that different sized and shaped cigarettes/cigars can be rolled using the cigarette rolling apparatus. In one embodiment, the cigarette rolling apparatus is configured to roll a cigarette or cigar that holds approximately 0.3 g-500 g of smoking material. In one embodiment, multiple papers can be disposed on belt portion 55 to roll multiple cigarettes or cigars at the same time with one motion of handle 44. In an alternative embodiment, handle 44 can be pivotably adjusted in the opposite direction from the front of base 10 to the rear of base 10 to roll smaller sized cigarettes if desired.

Figure 6:
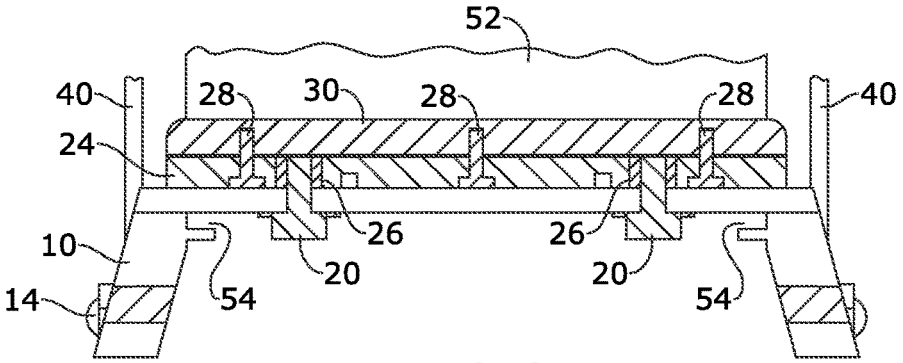
FIG. 6 depicts a section view of certain embodiments of the cigarette rolling apparatus taken along line 6-6 in FIG. 2.

In one embodiment as depicted in FIGS. 3 and 6, base 10 comprises slots 54 between main plate 11 and side plates 13. Slots 54 are configured to receive a tray that can catch any excess smoking material that squeezes off belt 52 and falls through openings 58 in main plate 11 during the rolling process. The captured smoking material on the tray allows the user to reuse the smoking material to form another cigarette.

It shall be appreciated that the components of the cigarette rolling apparatus described in several embodiments herein may comprise any alternative known materials in the field and be of any color, size and/or dimensions. It shall be appreciated that the components of the cigarette rolling apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A cigarette rolling apparatus for use to form different sized cigarettes with enhanced efficiency, the cigarette rolling apparatus configured to form a cigarette by rolling a paper around a smoking material, the cigarette rolling apparatus comprising:

a base comprising a main plate and a pair of side plates coupled thereto, the pair of side plates extending along opposing side edges of the main plate;

a ramp coupled to a top face of the main plate, the ramp comprising a top surface that extends along a curved pathway from a front end of the ramp to a rear end of the ramp;

a handle comprising a pair of arms pivotably mounted to the pair of side plates of the base, the handle comprising a pair of rollers rotatably mounted to the pair of arms of the handle; and a belt comprising a first end coupled to the main plate proximate a front end of the base and a second end coupled to the main plate proximate a rear end of the base, the belt extending along the top surface of the ramp and around the pair of rollers mounted to the handle;

wherein the handle in an upright load position forms a U-shaped pocket in the belt between the ramp and pair of rollers configured to receive the smoking material therein and a portion of the belt on the top surface of the ramp configured to receive the paper, wherein pivotal movement of the handle from the upright load position toward the front end of the base allows the pair of rollers to rotatably adjust and apply compression forces on portions of the belt to roll the paper around the smoking material on the belt, thereby forming the cigarette.

2. The cigarette rolling apparatus of claim 1, wherein the pair of arms of the handle are pivotably mounted to mounting locations that are off-center on the base.

3. The cigarette rolling apparatus of claim 2, wherein the first end of the belt is slidably mounted to the main plate of the base and the second end of the belt is slidably mounted to the main plate of the base, wherein the first end of the belt or the second end of the belt is configured to slidably adjust relative to the base to adjust a degree of slack in the belt.

4. The cigarette rolling apparatus of claim 3, further comprising a first clamp slidably mounted to the main plate and coupled to the first end of the belt and a second clamp slidably mounted to the main plate and coupled to the second end of the belt.

5. The cigarette rolling apparatus of claim 4, wherein the front end of the ramp is located a first distance from the main plate of the base and the rear end of the ramp is located a second distance from the main plate of the base, wherein the first distance is less than the second distance.

6. The cigarette rolling apparatus of claim 5, further comprising a notch extending along a central portion of the top surface of the ramp.

7. The cigarette rolling apparatus of claim 6, wherein the ramp comprises a pair of legs coupled to the main plate of the base.

8. The cigarette rolling apparatus of claim 7, wherein the ramp comprises a storage compartment configured to store a plurality of items.

9. The cigarette rolling apparatus of claim 8, wherein the main plate of the base comprises a plurality of openings.

10. The cigarette rolling apparatus of claim 9, wherein the base comprises a pair of slots configured to secure a tray beneath the plurality of openings in the main plate of the base.

* * * * *